United States Patent [19]

Tarnoff

[11] 4,039,017

[45] Aug. 2, 1977

[54] HEAT RADIATION CLOSURE

[75] Inventor: Sherwin S. Tarnoff, Northbrook, Ill.

[73] Assignee: Air Balance, Inc., Chicago, Ill.

[21] Appl. No.: 693,270

[22] Filed: June 4, 1976

Related U.S. Application Data

[63] Continuation of Ser. No. 625,855, Oct. 28, 1975, abandoned, which is a continuation of Ser. No. 541,523, Jan. 16, 1975, abandoned, which is a continuation-in-part of Ser. No. 385,475, Aug. 3, 1973, Pat. No. 3,861,443.

[51] Int. Cl.[2] ..... E05F 15/20; E06B 3/94

[52] U.S. Cl. ..... 160/1; 160/84 R

[58] Field of Search ..... 160/1-6, 160/32, 34, 35, 84 R

[56] References Cited

U.S. PATENT DOCUMENTS

| | | | |
|---|---|---|---|
| 2,874,611 | 2/1959 | Luboshez | 160/84 R X |
| 3,273,632 | 9/1966 | McCabe | 160/1 |
| 3,687,185 | 9/1972 | Singer | 160/1 |
| 3,861,443 | 1/1975 | Tarnoff | 160/84 R X |
| 3,877,525 | 4/1975 | Husson et al. | 160/1 X |

*Primary Examiner*—Philip C. Kannan

*Attorney, Agent, or Firm*—Fitch, Even, Tabin & Luedeka

[57] ABSTRACT

Radiation shielding for limiting the transfer of heat by radiation is provided for a ceiling closure having a curtain wall shiftable from an open position allowing air flow through an opening in the ceiling to a closed position in which the curtain wall blocks air flow through the opening. The radiation shielding comprises a plurality of radiation shields formed of air impermeable, heat resistant, flexible fabric sheets folded for storage and for unfolding into generally planar sheets with shifting of the curtain wall into the closed position wherein the fabric sheets define and confine a dead air space. The sheets are preferably made of tightly woven asbestos coated to retain asbestos fibers against liberation into an air stream. Reflective coatings act to retard the radiation of heat.

12 Claims, 5 Drawing Figures

HEAT RADIATION CLOSURE

The application is a continuation of copending application Ser. No. 625,855, filed Oct. 28, 1975, and now abandoned, which in turn was a continuation of application Ser. No. 541,523, filed Jan. 16, 1975, and now abandoned, which in turn was a continuation-in-part of application Ser. No. 385,475, filed Aug, 3, 1973, now U.S. Pat. No. 3,861,443, issued Jan. 21, 1975.

The invention relates to heat radiation closures and more particularly to ceiling closures having a curtain wall movable from an open condition in which air may flow through an opening in a ceiling to a closed position in which the curtain wall substantially blocks the flow of air and smoke or fire through the ceiling.

Closures of this general kind usually include a rectangular frame for fitting in an air duct and are usually installed in a horizontal position as in a ceiling or floor.

In the closures of the aforesaid application Ser. No. 385,475, folded stack of hinged blades is held adjacent one end of a damper frame by a heat releasable means, such as a fusible link which melts when exposed to high temperature to allow the blades to move to block air flow through the damper. In horizontal installations, springs are connected to the blade assembly to pull the blades across the damper opening when the fusible link or other temperatures actuated means releases the blades for unfolding into a flat planar curtain wall.

Dampers of the aforementioned kind usually have steel blades and a steel frame, which provides good structural strength to maintain the curtain wall closed to any substantial flow therethrough of smoke, fire and heated air when the damper is exposed to high temperature fires and when streams of water from fire hoses are played thereagainst. In addition, a pair of asbestos fabric shields have been disposed on respective sides of the blades and spaced therefrom for effectively limiting heat transfer by radiation to alleviate the likelihood of ignition of or failure of structural materials on the other side of the fire damper from the heat source.

These fire and radiation dampers have proven satisfactory for their purposes. However, the present invention provides a simpler closure that is more effective in limiting heat transfer by radiation, in fact, so effective that the central steel blades may be eliminated where their structural strength is not required.

Accordingly, a general object of the present invention is to provide a new and improved closure capable of severely limiting the transfer of heat by radiation through an opening.

Other objects and advantages of the invention will become apparent from the following detailed description, particularly when taken in connection with the accompanying drawings in which.

Figure 1:
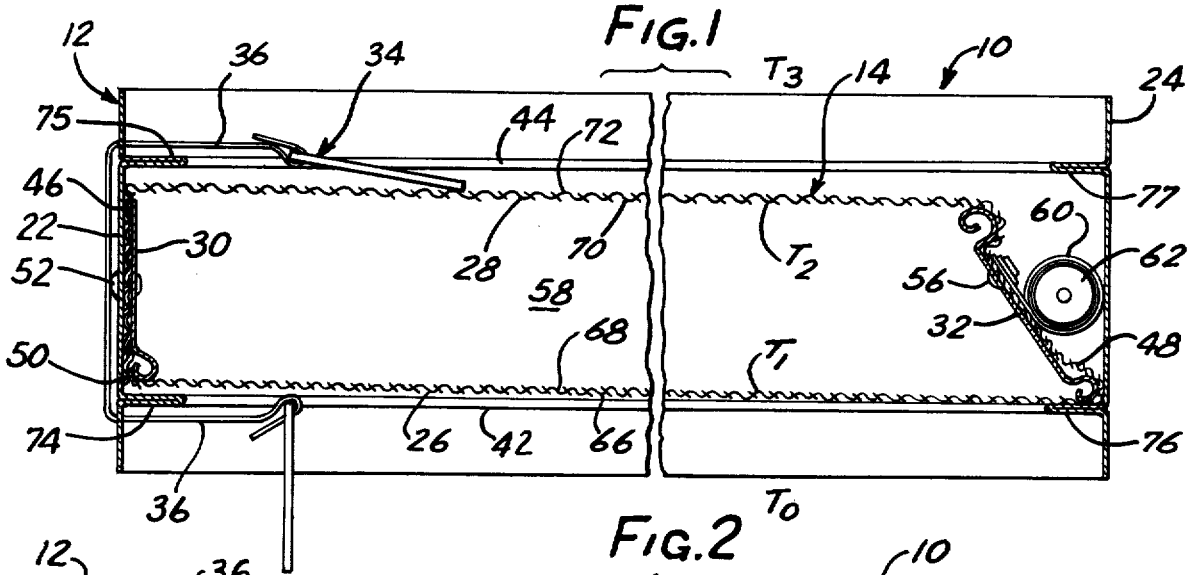
FIG. 1 is a cross-sectional view of the closure with its curtain wall in the closed position and embodying the novel features of the invention.
Figure 2:
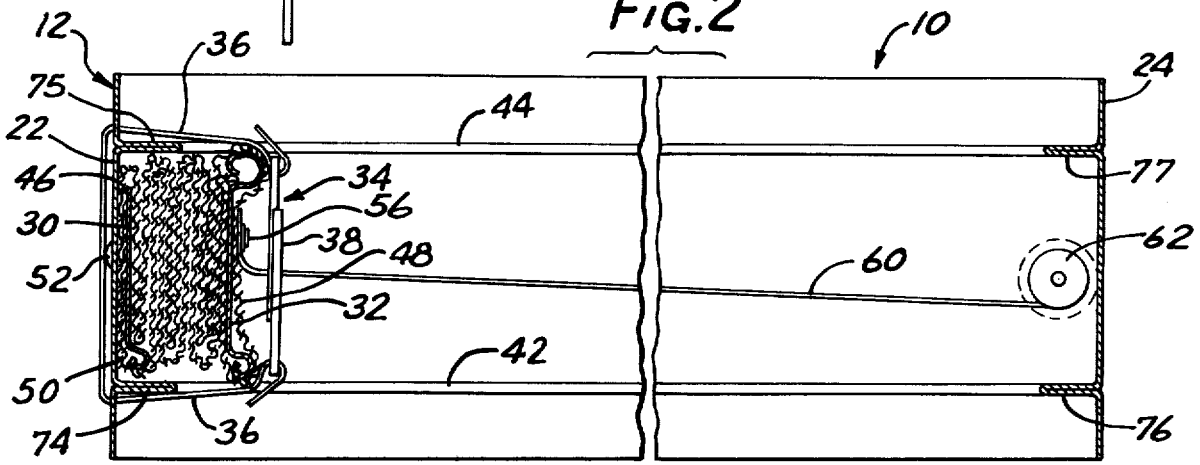
FIG. 2 is a cross-sectional view similar to FIG. 1 but with the curtain wall in the open position.
Figure 3:
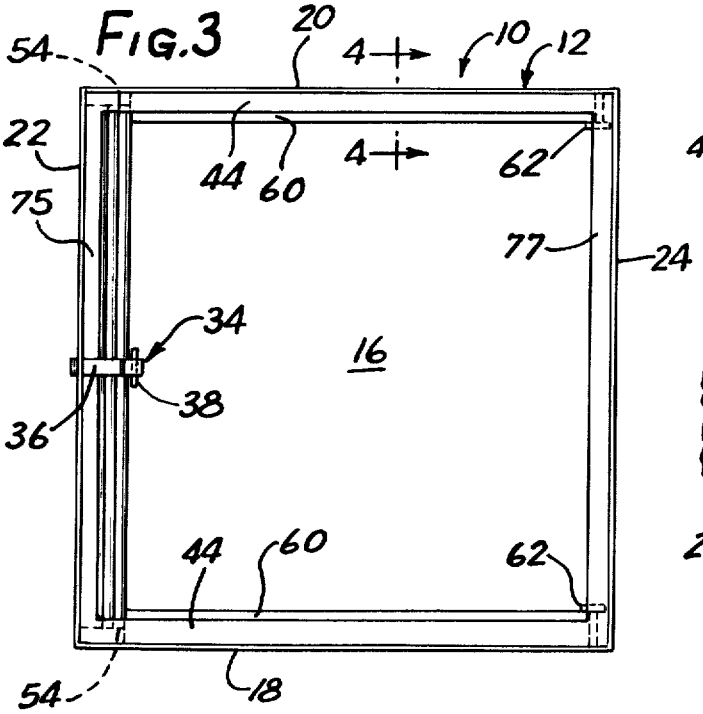
FIG. 3 is a plan view of the closure shown in FIG. 2.
Figure 4:
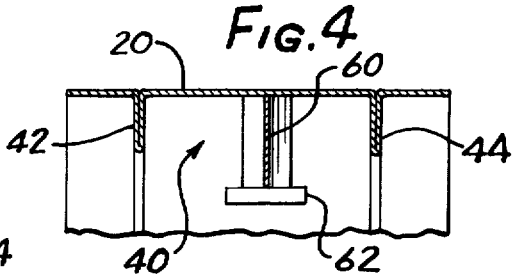
FIG. 4 is a cross-sectional view of a portion of the closure, taken along the line 4-4 of FIG. 3.

As shown in the drawings for purposes of illustration, the invention is embodied in a closure 10 having a frame 12 and a curtain wall 14, as best shown in FIG. 1. The curtain wall 14 is movable between the closed position shown in FIG. 1 in which the curtain wall closes an opening 16 (FIG. 3) through the rectangular frame 12 and an open position, as best seen in FIGS. 2 and 3, in which the curtain wall is folded to the stowage end of the frame and exposes the opening 16, thereby allowing the flow of air through the frame. The frame is typically of rectangular shape (which includes square), with a first pair of parallel side walls 18 and 20 joined at opposite ends to a second pair or parallel end walls 22 and 24. Herein, the curtain wall 14 comprises a plurality of radiation shields 26 and 28 having their respective ends connected to a fixed blade 30 and a movable blade 32 for moving between the folded position, shown in FIGS. 2 and 3, and the unfolded position shown in FIG. 1. The radiation shields 26 and 28 are formed of substantially air impermeable, heat resistant, flexible fabric sheets, tightly woven sheets of asbestos in the preferred embodiment.

The curtain wall 14 is held in the open position by a releasable securing means 34, which may take several forms but herein is illustrated as including a pair of straps 36 carrying a fusible link 38 extending across the movable blade 32. The fusible link will, on the occurrence of excessive heat as occasioned by a fire and at a predetermined temperature, melt, releasing the blade 32 and the radiation shields 26 and 28 to move to the closed position forming the curtain wall as shown in FIG. 1, closing the opening the opening 16 and confining the fire. In other instances, a heat sensor located at a remote location may actuate means to release the link 38, thereby releasing the blade 32 and radiation shields 26 and 28 to shift to the closed position.

The illustrated radiation shields 26 and 28 extend the width of the blades 30 and 32 and into opposite channels 40 each defined between a pair of guide flanges 42 and 44 which project inwardly from the side walls 18 and 20 of the frame and guide the movable blade 32. In this preferred embodiment of the invention, the radiation shields 26 and 28 are both formed from a single piece of woven asbestos fabric 45 which has a first end 46 at the stowage end wall 22 of the frame and, in the closed position, extends over the opening 16 to define the radiation shield 26 to an integral bight portion 48 looped about the underside of the movable blade 32. The bight portion 48 is integral with the radiation shield 28 and this, in turn, extends to the other end 50 of the asbestos fabric, which end overlaps the first end of the fabric.

The ends 46 and 50 of the asbestos fabric 45 are sandwiched and captured between the fixed blade 30 and the stowage end wall 22 by a pair of fasteners 52, such as rivets. The latter secure the blade tightly to the frame and hold the fabric ends parallel and aligned so that opposite edges 54, FIG. 3, of the fabric are parallel to the frame side walls 18 and 20 when the shields 26 and 28 are in the closed position. The bight portion 48 of the fabric may be secured to the movable blade 32 by a series of fasteners 56 to assure proper positioning of the radiation shields 26 and 28 across the opening 16 when the blade 32 is moved along the guide flanges 42 and 44 and side walls 18 and 20 to the closed position. The length of the respective shields is related to the final position of the movable blade 32, when the curtain wall is in the closed position, such that the shields 26 and 28 are relatively taut and are kept apart by the fixed and movable blades 30 and 32 to afford minimal contact with each other, thereby defining, confining and maintaining a dead air space 58.

In accordance with the present invention, the radiation shields 26 and 28 are in a stowed condition at the stowage end of the opening 16 by being folded between the blades 30 and 32. When the blade 32 moves from the open position shown in FIG. 2, the fabric unfolds to provide the generally planar sheet-like radiation shields 26 and 28, each extending the width and length of the damper opening 16. The shields 26 and 28 also extend beyond the opening 16. Springs 60 are provided to pull the curtain wall 14 to the closed position. In this instance, each of a pair of springs 60 is fastened to an outer end of the blade 32 by one of the fasteners 56 which also serve to fasten the bight 48 of the fabric to the blade 32. The springs 60 are usually metal, constant tension springs which are disposed in the opposite channels 40 adjacent the side walls 18 and 20 of the frame for winding about spools 62. The spools 62 are disposed in the channels 40 and are fastened to the side walls 18 and 20, as best seen in FIG. 3, near the frame end wall 24.

The preferred fabric is tightly woven asbestos fabric provided with a fiber retention coating 65 to limit fiber liberation from the fabric by the moving air stream. Under recent health and safety codes, asbestos fiber materials, which have been found to be injurious to health, are regulated, particularly for use in air moving equipment or in air ducts in which streams of moving air may abrade or erode fibers from the shield. The coating 65 is present on both sides 66 and 68 of the radiation shield 26 and both sides 70 and 72 of the radiation shield 28. Such coatings of the entire asbestos fabric have reduced the amounts of asbestos fibers liberated to well below acceptable levels and to as low as 0.015 particles per cubic centimeter.

Figure 5:
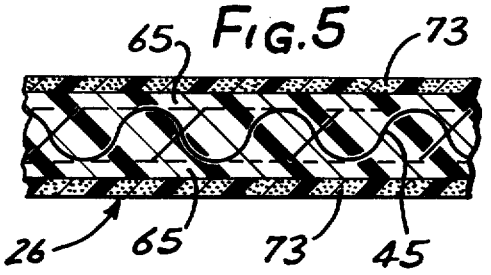
FIG. 5 is an enlarged sectional view of one of the radiation shields shown in FIG. 1.

The closure as thus far discribed is similar to the damper described in copending application Serial No. 385,475 except for the absence of the metal folding curtain intermediate the radiation shields. It has been found that with the improved radiation shields of the present invention, the intervening metal curtain is generally unnecessary except where its structural strength is required. In accordance with the present invention, the radiation shields 26 and 28 are coated with reflective coatings 73 (FIG. 5).

In the preferred embodiment of the present invention the reflective coatings 73 are applied over the fiber retention coatings 65. A preferred fabric is a tightly woven asbestos fabric weighing 24 oz./sq.yd. as sold by Raybestos Manhattan Inc., of Bridgeport, Connecticut. The fiber retention coatings 65 are preferably thin coatings of a flame resistant blend of acrylic materials sold by Rohm and Haas, Philadelphia, Pennsylvania as HA20, HA8 and Rhoplex. The reflective coatings 73 are preferably this same material as a binder filled with aluminum powder. Aluminum powder sold by Reynolds Metals Company of Richmond, Virginia, as MD2100 has been found suitable. A total coating weight of approximately 4.5 oz./sq.yd. has proven effective.

The reflective coating 73 has a small fraction of the radiancy of asbestos and provides a radiation barrier so effective as to meet Underwriters'Laboratories (UL) tests as are required for many installations. The critical criterion is that the emissivity of the finished fabric be a small fraction of that of a black body, producing a radiancy low enough that the resulting closure meets the safety standard of Underwriters'Laboratories as accepted by various building codes and the industry. At the temperatures involved, the emissivity of asbestos is typically about 0.95 while the emissivity of aluminum is about 0.15 and aluminum oxide about 0.18. The emissivity of aluminum oxide is significant, as at the elevated temperatures reached in fires the aluminum powder may oxidize, while remaining on the asbestos fabric. Thus an emissivity less than about 0.2 (one-fifth the emissivity of a black body) has been found effective. Tests have shown that under UL test conditions heat transfer through a closure made according to the present invention was substantially less than the heat transfer through a comparable closure made pursuant to the disclosure of copending application Ser. No. 385,475, with the intermediate folding blade curtain wall but without the reflective coatings of the present invention.

Although in the event of fire the coatings may melt when subjected to the high temperatures contemplated herein, the melting of the coatings does not unduly adversely affect the heat transfer limiting qualities of the radiation shields 26 and 28 and of the closure 10. The asbestos fabric is formed with a tight weave so that even after the coatings melt, the radiation shields 26 and 28 remain sufficiently impermeable as to block air flow therethrough substantially and thereby limit heat transfer by convection through the pores of the fabric. That the retention coatings are destroyed by fire and thereupon liberate the asbestos fibers is not significant as the radiation shields still function effectively for their intended purpose. The release of asbestos fibers during the emergency is negligible, and the asbestos fabric will not be used again after the emergency. The closure will be replaced or repaired. As stated above, the reflective coatings 73 remain, if somewhat changed in form.

By appropriately proportioning the radiation shields 26 and 28 and the blades 30 and 32 relative to the opening 16 and the walls 18, 20, 22 and 24, the radiation shields 26 and 28 effectively close the opening 16 when the closure 10 is in the closed position so that there is but a relatively small flow of air through the opening. To this end the lower radiation shield 26 is held near a lower flange 74 on the end wall 22 by the fixed blade 30, and the upper radiation shield 28 is similarly held near an upper flange 75. The movable blade 32 is guided by the flanges 42 and 44 and is urged by the springs 60 to hold the lower radiation shield against a lower flange 76 on the end wall 24 when in the closed position and near an upper flange 77. This holds the radiation shield 26 generally against the guide flanges 42 to close the entrance of the opening 16, and it backs the radiation shield 26 with the air space 58 which generally fills the opening 16 and substantially closes the exit from the opening at the flanges 44, 75 and 77.

In accordance with the present invention, improved resistance to heat transfer and particularly to heat transfer by radiation and convention is provided by spacing at least two radiation shields 26 and 28 from one another to define and confine therewith an air space 58 when the shields are extended to cover the opening 16. Because of the generally small dead air space 58, heat transfer by convection between radiation shields 28 and 30 is not great. Also, as will be explained in greater detail, the two radiation shields 28 and 30 reflect radiation and effectively divide the closure into a plurality of successive re-radiation zones or sections with a plurality of temperature drops therebetween. As a result of these re-radiation zones, the total effect of radiant heat transferred is, as may be calculated by using the Stefan-Boltzmann law, considerably reduced from prior art dampers without such re-radiation zones. This greater number of re-radiation and temperature drop zones results in successively lower maximum radiating temperatures at each of the successive heat radiating surfaces; and, because radiation according to the Stefan-Boltzmann law depends upon the difference between the fourth powers of the temperatures of the radiating surfaces, the result of reducing temperature differentials becomes a very significant factor in the overall amount of heat transferred.

A plurality of re-radiation zones were present in the damper of copending application Ser. No. 385,475; however, with the substantially lower emissivity of the surfaces of the radiation shields of the present invention, a lower heat transfer is achieved with one less re-radiation zone and without the folded metal curtain.

Assuming a fire is below the closure 10 and produces a temperature $T_0$ on the underside of the closure at a relatively high temperature, for example 1800° F., the heat from the fire is transferred by radiation and convection to the under surface 66 of the radiation shield 26. Heat is then conducted by conduction therethrough to the interior surface 68 of the radiation shield to raise its temperature to a temperature $T_1$. The heated interior shield surface 68 will radiate the heat to the facing surface 70 of the radiation shield 28, heating the latter to a temperature $T_2$. Heat will flow through the shield 28 by conduction to the top side 72 thereof. Heat is re-radiated therefrom to the surrounding atmosphere to raise the temperature on the side of the closure to a temperature $T_3$. From the standpoint of heat transfer by convection, the space 58 is generally intended to be a small closed air space with any air flow circulating therein by natural convection being relatively slow moving and without achieving a good scrubbing of surface air at the interior shield surfaces 69 and 70. The net result is a low convection heat transfer between the interior surface 68 of the shield 26 and the facing surface 70 of the shield 28.

That the radiation shields 26 and 28 are generally spaced from one another over the opening 16 when in the closed position does not exclude substantial and intimate contact with each other at the blades 30 and 32 as the locations of these blades are protected or hidden by the flanges 74 and 76 on the end walls 22 and 24. While the heat is transferred to and through the frame and therefrom, this quantity of heat transferred has not resulted in a failure of the illustrated damper in actual radiation tests, as described herein.

Closures of the type described herein have successfully passed the fire test of Underwriters'Laboratories Standard 263, "Standard For Fire Tests of Building Construction and Materials", (ANSI A 2.1-1970 ) in which the closures were mounted horizontally in a ceiling. The ceiling was formed of fire resistant tiles, spaced by a plenum chamber from an overhead slab. In this Underwriters'Laboratories test (Standard 263, pp. 9 and 29 ), the temperature in the room ($T_0$) is raised in a programmed manner to 1550° F. in 30 minutes, to 1700° F. in 1 hour, to 1850° F. in 2 hours, to 2000° F. in 4 hours, to 2150° F. in 6 hours. In this test two closures of the present invention 12 in. and 24 in. square, respectively, were tested comparatively with an approved hinged-door damper covering a 12 in. diameter duct. As reported by Underwriters'Laboratories in its published report of Sept. 24, 1974, "Report on Ceiling Dampers in Fire Resistive Assemblies, Air Balance, Inc.", File R7127-3, Project 74NK2080, the 12 in. closure successfully blocked heat transfer therethrough more effectively than the comparison standard at all temperatures, while the 24 in. closure performed approximately the same as the standard for 150 minutes (up to about 850° F. joist temperatures) and better thereafter (at the higher temperatures). The closures of the present invention were thus found effective for UL classification.

From the foregoing, it will be seen that the present invention provides an improved closure particularly resistant to radiation heat transfer. While a preferred embodiment has been shown and described, it will be understood that there is no intent to limit the invention by such disclosure, but rather, it is intended to cover all modifications and alternate constructions falling within the spirit and scope of the invention as defined in the appended claims.

What is claimed is:

1. A ceiling closure comprising a metallic frame of rectangular shape formed by first and second end walls, and two side walls joining the end walls to encompass a rectangular opening in said metallic frame through which air may flow, first and second radiation shields each formed of a substantially air impermeable, heat resistant, flexible fabric sheet secured at one end to said first end wall, said sheets being coated with reflective coating material for reducing the transfer of heat, means for holding said first and second radiation shields in a stowed position adjacent said first end wall permitting air to flow through said opening, and operable in response to high temperatures to release said first and second radiation shields for movement to a closed position in which said shields extend across said opening and substantially close the latter to air flow therethrough, means for moving said first and second radiation shields from said stowed position to said closed position, said means shifting the other ends of said first and second radiation shields to positions adjacent said second end wall, and means associated with said first and second radiation shields for spacing said first and second radiation shields from each other when in said closed position to enclose a dead air space therebetween with said first and second radiation shields having respective surfaces substantially parallel to and facing each other across said air space, thereby limiting heat transfer by conduction therebetween.

2. A ceiling closure in accordance with claim 1 wherein said fabric sheets are formed of woven asbestos coated with coating material having a heat emissivity a small fraction of that of asbestos.

3. A ceiling closure in accordance with claim 1 wherein said sheets are coated on both sides with said coating material.

4. A ceiling closure in accordance with claim 1 wherein said coating material contains a form of aluminum as the effective heat emitting surface.

5. A ceiling closure in accordance with claim 4 wherein said coating material is formed of aluminum powder in a plastic binder.

6. A ceiling closure in accordance with claim 2 in which coatings on said sheets retain fibers of asbestos from liberation into an air stream flowing through said opening.

7. A closure comprising a metallic frame of rectangular shape formed by first and second end walls, and two side walls joining the end walls to encompass a rectangular opening in said metallic frame through which air may flow, first and second radiation shields each formed of a substantially air impermeable, heat resistant, flexible fabric sheet secured at one end to said first end wall, respective surfaces of said sheets having a heat emissivity a small fraction of that of a black body, means for holding said first and second radiation shields in a stowed position adjacent said first end wall permitting air to flow through said opening, and operable in response to high temperatures to release said first and second radiation shields for movement to a closed position in which said shields extend across said opening and substantially close the latter to air flow therethrough, means for moving said first and second radiation shields from said stowed position to said closed position, said means shifting the other ends of said first and second radiation shields to positions adjacent said second end wall, and means associated with said first and second radiation shields for spacing said first and second radiation shields from each other when in said closed position to enclose a dead air space therebetween with said first and second radiation shields having respective surfaces substantially parallel to and facing each other across said air space, thereby limiting heat transfer by conduction therebetween.

8. A closure in accordance with claim 7 wherein said small fraction is less than about 0.2.

9. A closure in accordance with claim 7 in which said first and second shields each comprises an asbestos fabric sheet coated on both sides with coating material having said heat emissivity a small fraction of that of a black body.

10. A closure in accordance with claim 9 wherein said coating material contains a form of aluminum as the effective heat emitting surface.

11. A closure in accordance with claim 10 wherein said coating material is formed of aluminum powder in a plastic binder.

12. A closure in accordance with claim 9 in which coatings on said sheets retain fibers of asbestos from liberation into an air stream flowing through said opening.

* * * * *